US006364715B1

(12) United States Patent
Liu et al.

(10) Patent No.: US 6,364,715 B1
(45) Date of Patent: Apr. 2, 2002

(54) COMPOSITE INTERFACE STRUCTURE FOR JACK-PLUG SOCKETS

(75) Inventors: Sen-Hsiang Liu; Chih-Chin Hu, both of Hsi Chih (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 09/906,778

(22) Filed: Jul. 18, 2001

(30) Foreign Application Priority Data

Jun. 8, 2001 (TW) ..... 90113930

(51) Int. Cl.[7] ..... H01R 25/00; H01R 27/02; H01R 31/00

(52) U.S. Cl. ..... 439/638; 439/676

(58) Field of Search ..... 439/638, 676, 439/170, 172, 175

(56) References Cited

U.S. PATENT DOCUMENTS 4,651,418 A * 3/1987 Hutchins ..... 29/884
5,129,841 A * 7/1992 Allina et al. ..... 439/517
5,425,172 A * 6/1995 Carswell et al. ..... 29/884
6,113,432 A * 9/2000 Liao ..... 439/638

* cited by examiner

*Primary Examiner*—Tulsidas Patel
*Assistant Examiner*—Chandrika Prasad
(74) *Attorney, Agent, or Firm*—Troxell Law Office PLLC

(57) ABSTRACT

A composite interface structure for jack-plug sockets for mounting to one end of a communication line to provide a plug structure and a jack structure simultaneously includes a body, a plurality of metal strips and a jack frame. The body has one end formed a plug structure, and another end connected the communication line and having a jack frame mounted thereon, and a plurality of longitudinal wire troughs on one side of the body between the two ends for housing the metal strips. The metal strips are embedded in the wire troughs to serve as external contacts of the communication line. The jack frame is straddled over the body and has a jack space formed therein to receive an external plug. The invention further may include a slide mechanism to allow the jack frame to move up or down relative to the body. The interface structure thus constructed is convenient to use and carry.

6 Claims, 7 Drawing Sheets

COMPOSITE INTERFACE STRUCTURE FOR JACK-PLUG SOCKETS

FIELD OF THE INVENTION

The present invention relates to a composite interface structure for jack-plug sockets and particularly a composite structure that has at least a jack socket engaging with a plug to facilitate various connecting applications.

BACKGROUND OF THE INVENTION

In the commonly used electric and electronic products such as telephones, facsimiles machine, computers and the like, the jack-plug socket is a widely used interface for connecting or extending the communication lines. The connection is usually accomplished by coupling a plug to a jack. However in practice, different devices or equipment might provide same type of connection interface (such as all have plugs, or jacks). In such occasions, another connector must be prepared as an interface to complete the connection.

For instance, when two communication lines provide plugs as interfaces, the connection of these two communication lines will need a jack socket as a connection medium. Hence when deploying the electronic and communication facilities, in order to connect the equipment and devices that have same type of connection interfaces (usually plugs), users have to prepare and select connection attachments which are compatible to the connection interfaces (such as compatible jacks) to establish the required connection.

The connection attachment is an additional element and is a third component. To prepare and set up such an attachment is not convenient. The contemporary trends for development of electronic products are highly focusing on light weight and slim size. To prepare and carry extra connection interface media takes extra space and is troublesome. For example, to connect two jack interfaces, an additional plug interface has to be prepared. It occupies more space and is not convenient to carry and use.

FIG. 1 illustrates a movable connector disclosed in U.S. Pat. No. 6,113,432. The connector includes a seat 1, an upper cover 2, a sliding mechanism 5 allowing the upper cover 2 movable on the seat 1, two jack spaces 3 formed between the upper cover 2 and the seat 1, and a plurality of metal conducting wires 4 located at the bottom of the jack space 3 to connect the two plug spaces 3. The sliding mechanism 5 allows the upper cover 2 moving downwards closed to the seat 1 thereby to resolve slightly the problem of additional space occupied by the attachments.

However, the techniques set forth above still cannot resolve the problem of the third component nature of the additional attachment. Users still have to carry and setup an extra element to make connection. It is not a convenient or desirable way. There are still rooms for improvement.

SUMMARY OF THE INVENTION

The primary object of the invention is to provide a composite interface structure for jack-plug sockets to improve the connection interface of a single communication line such that a jack interface or plug interface can connect another communication line without using an additional third connector.

Another object of the invention is to provide a compact composite interface structure for jack-plug sockets that has a simple slide mechanism to allow the jack section moving downward to the plug section to reduce the total size and space.

A further object of the invention is to provide an easy-to-carry composite interface structure for jack-plug sockets that is directly attached to a communication line so that electronic devices may be freed from the problem of equipping a third connector.

The interface structure according to the invention consists of a body, a plurality of metal strips and a jack frame.

In one embodiment of the invention, the interface structure includes a plug structure and a jack structure. The plug structure is formed at one end of the body for receiving an external jack structure. Another end of the body connects a communication line. A plurality of longitudinal wire troughs are formed on one side of the body between the two ends for housing the metal strips.

The metal strips are embedded respectively in the wire troughs. Each metal strip has a front bulged stub at a front end, a lower bifurcate contact to connect the communication line in the wire trough and an upper jut at another end. When the metal strip is embedded in the wire trough, the front bulged stub is extended outside the plug structure of the body, and the upper jut is extended outside the wire trough.

The jack frame is straddled over the body at one side where the communication line is located. Inside the jack frame, there is a jack space for housing an external plug. The wire troughs and upper juts are exposed to the jack space. The jack frame has a front opening formed at one end adjacent the plug structure of the body to receive the external plug into the jack space to contact the upper juts of the metal strips.

In the preferred embodiments of the invention, the interface structure may further include a slide mechanism to allow the jack frame moving downwards closed to the body when not in use to shrink the not using jack space. The slide mechanism may include slide rails attached to the body and a slide means located on the jack frame matching the slide rails.

In one embodiment of the invention, the interface structure may include a plug structure and two equal effect jack structures. The body has one end formed the plug structure for matching an external jack, another end installed a communication line, a plurality of longitudinal wire troughs formed on one side and a transverse slot communicating with the wire troughs.

The metal strips are embedded respectively in the wire troughs. Each metal strip has a front bulged stub at a front end, a lower bifurcate contact to connect the communication line in the wire trough and a first upper jut, and a second upper jut at another end. A metal extension arm is formed between the first upper jut and the second upper jut. When the metal strip is embedded in the wire trough, the front bulged stub is extended outside the plug structure, and the first and second upper juts are extended outside the wire trough. The metal extension arms are located in the transverse slot and are configured in a matching and staggering fashion.

The jack frame is straddled over the body at one side where the communication line is located, and has two ends located above the wire troughs. Each end has an opening. The openings at the two ends are opposite to each other and form respectively a jack space inside the jack frame for housing an external plug. The first and second upper juts are exposed to the jack space. Two external plugs may be inserted into the jack space through the two opposite openings. The staggering configuration of the metal strips in the transverse slot allows the two external plugs to form an equal effect relationship with the communication line.

In the preferred embodiments of the invention, the interface structure may further include a slide mechanism to allow the jack frame moving downwards closed to the body when not in use to shrink the not using jack space. The slide mechanism may include slide rails attached to the body and a slide means located on the jack frame matching the slide rails.

In another preferred embodiment of the invention, the metal extension arm may be covered by an insulation layer to ensure that the staggering configuration of the metal strips in the transverse slot has required insulation.

In yet another embodiment of the invention, the jack frame for housing two jack spaces may be divided in a front and a rear section each has a matching slide mechanism which may be moved up or down independently for each jack space.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
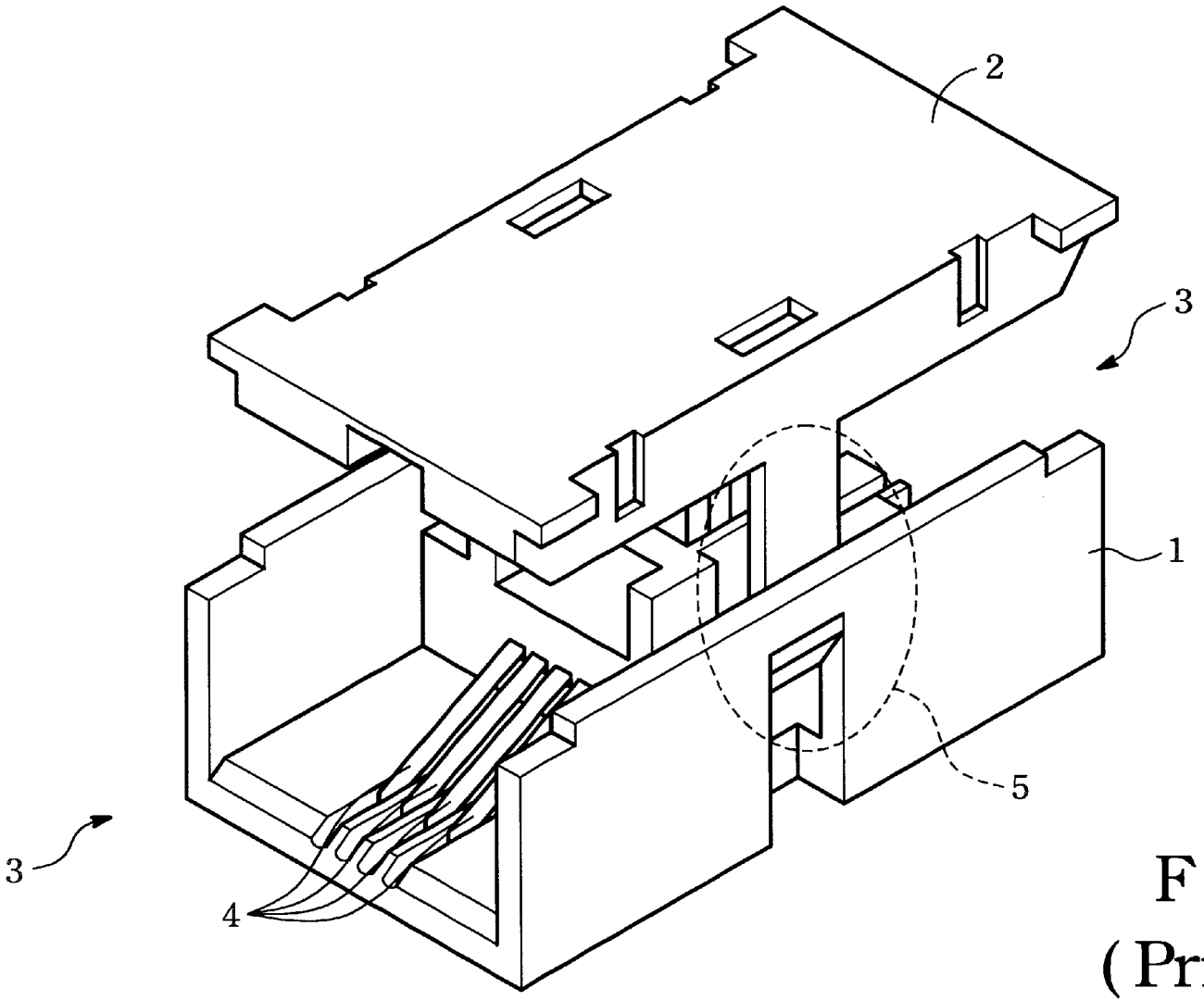
Fig. 1 (Prior Art)
FIG. 1 a perspective view of a conventional movable connecting seat of a telephone wire.

In the following descriptions, like reference characters and numerals designate similar parts throughout the various views to facilitate explanation.

The composite interface structure for jack-plug socket of the invention is mainly to combine a jack structure and a plug structure on a communication line connection interface to allow the communication line equipping a jack interface and a plug interface simultaneously without the need of including a third additional connector, therefore can connect another communication line of any interface structure.

Figure 2:
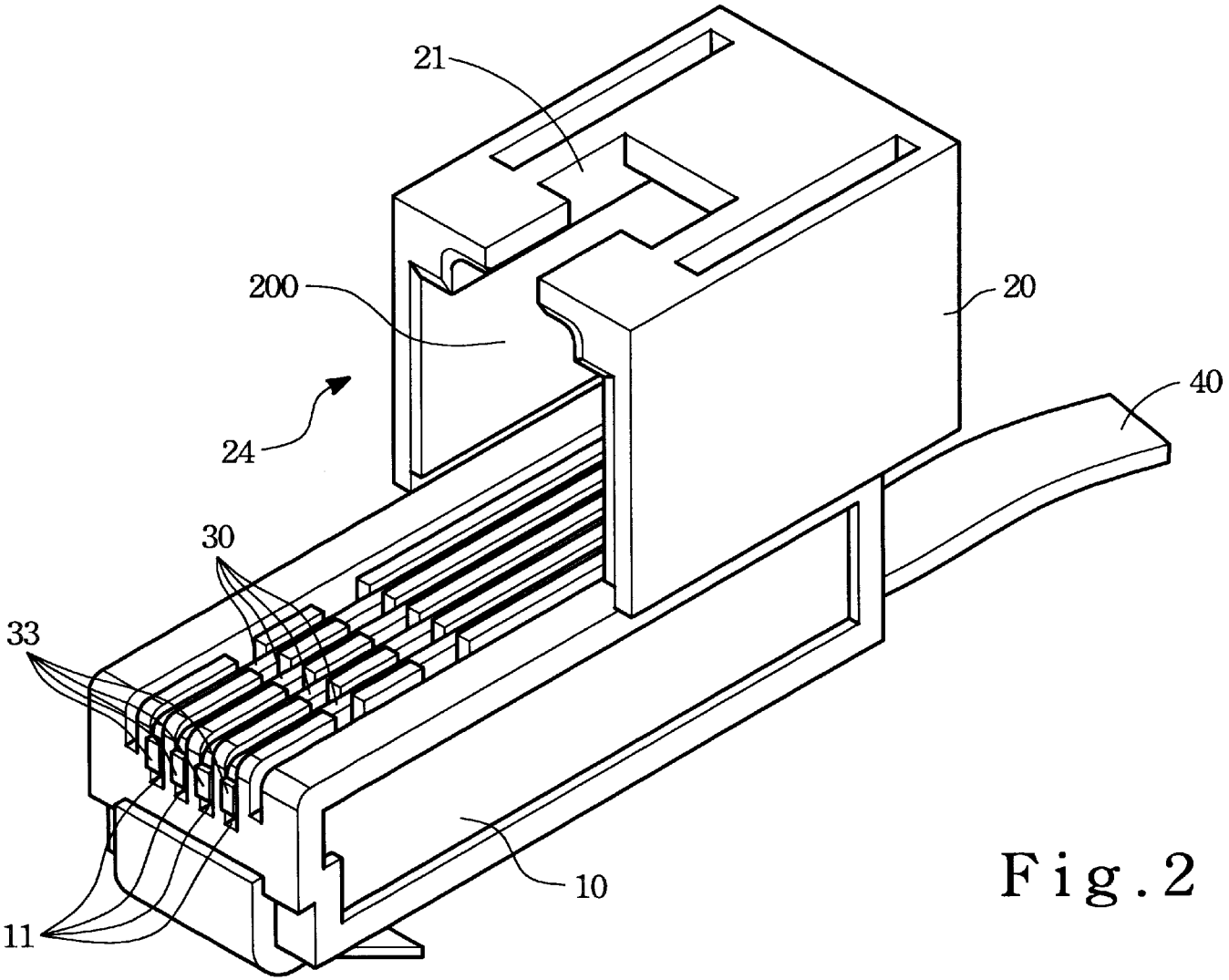
FIG. 2 is a perspective view of a first embodiment of the invention.

Referring to FIG. 2 for a first embodiment of the invention, the interface structure is connected to one end of a communication line 40 and includes a body 10, a plurality of metal strips 30 and a jack frame 20.

The first embodiment shown in the drawing includes a plug structure (on the left hand side of the drawing) and a jack structure (on the right hand side of the drawing). The body 10 has one end (left hand side) to couple with an external jack (not shown in the drawing) and another end (right had side) connected the communication line. There are a plurality of longitudinal wire troughs 1I formed between the two ends on one side (upper side) of the body for housing the metal strips 30.

The metal strips 30 (shown in FIG. 3B) are embedded respectively in the wire troughs 11. Each metal strip 30 has a front bulged stub 33 formed at one end thereof (left hand side in the drawing), a lower bifurcate contact 31 connecting the communication line 40 in the wire trough and an upper jut 32 located on the upper side of another end thereof (right hand side in the drawing). When the metal strip 30 is embedded in the wire trough 11, the front bulged stub 33 and the upper jut 32 are slightly extended outside the wire trough 11 of the body 10 to contact respectively the metal contacts of the external jack and plug.

The metal strips 30 may be fixed in the wire troughs 11 by using a position wedging method or other bonding techniques known in the art. They are well known to those skilled in the art, thus will be omitted here.

Referring to FIG. 2, the jack frame 20 is straddled over one side of the body 10 where the communication line 40 located (right hand side in the drawing). The frame 20 has a jack space 200 formed therein to match an external plug (not shown in the drawing). The wire troughs 11 and upper juts 32 are exposed in the jack space 200. The jack frame 20 has a front opening 24 adjacent the plug structure of the body 10 to receive an external plug into the jack space 200 to contact the upper juts 32 of the metal strips 30. As shown in the drawing, the jack frame 20 further has a snap notch 21 to engage with the clip of the external plug to allow the external plug held in the jack space 200 securely.

It is obvious, through the configuration arrangement of the body 10, jack frame 20 and metal strips 30 set forth above, the jack structure and plug structure may be built at one end of the communication 40 at the same time, thus can effectively resolve the convenience problem happened to the conventional techniques.

Figure 3A:
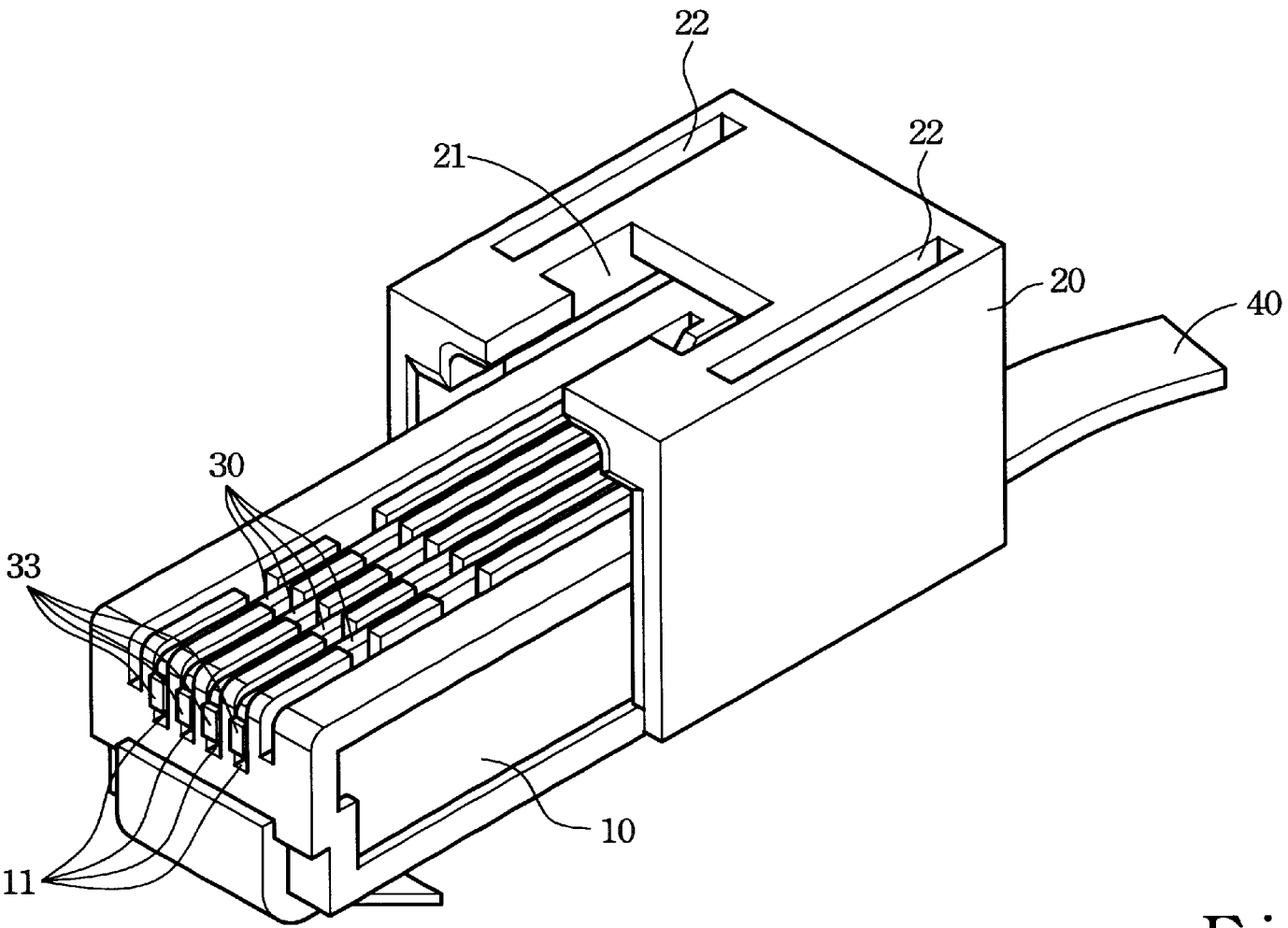
FIG. 3A is a perspective view of a second embodiment of the invention, with the jack frame withdrawn.
Figure 3B:
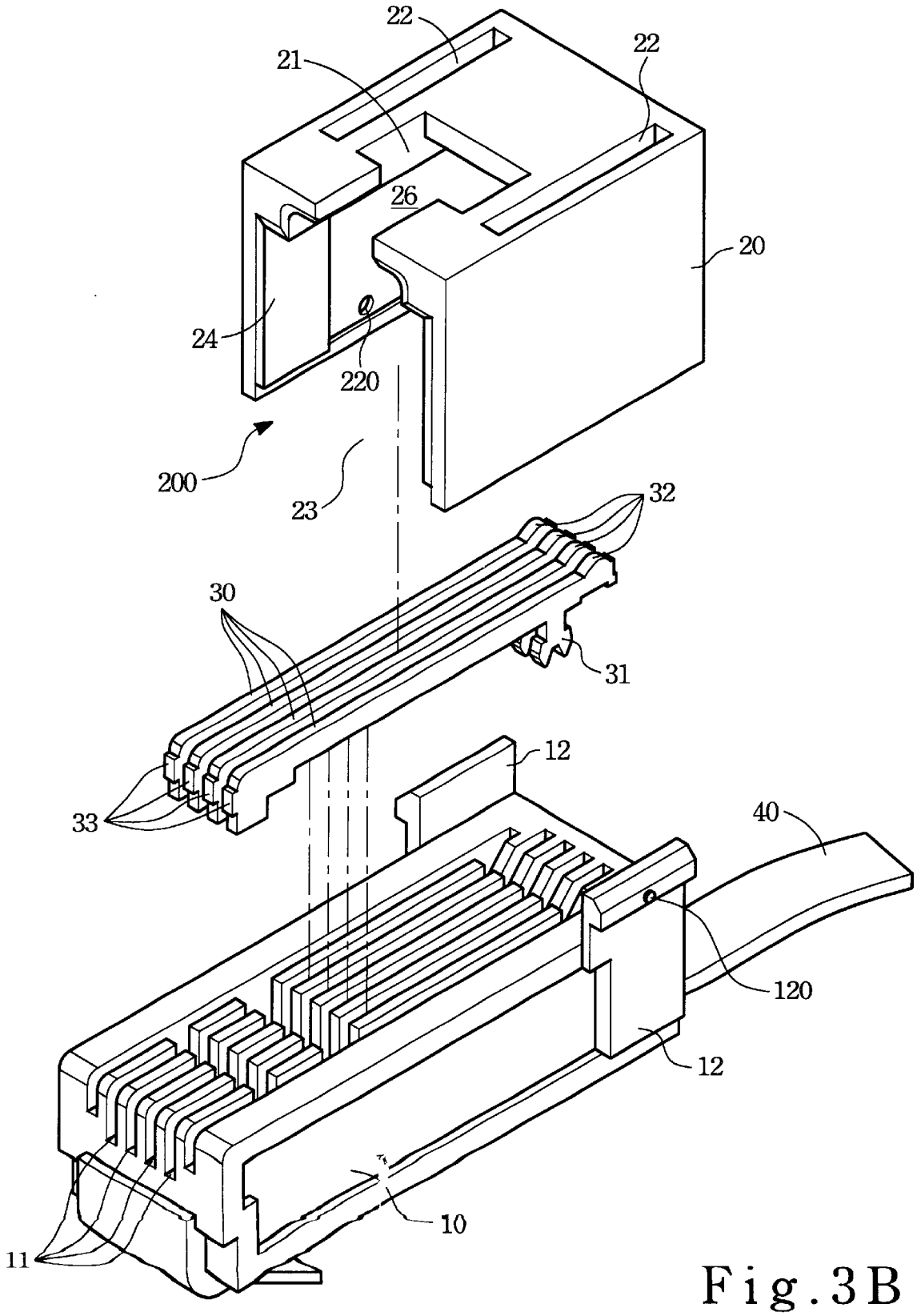
FIG. 3B is an exploded view of the second embodiment of shown in FIG. 3A.

FIGS. 3A and 3B show a second embodiment of the invention. The main difference from the first embodiment is the addition of a slide mechanism to allow the jack frame 20 moving down closed to the body 10 when not in use to shrink the jack space 200. Whereas in the first embodiment, the jack frame 20 is fixedly attach to the body 10.

In the present invention, the slide mechanism between the jack frame 20 and the straddled body 10 for making relative slide movement therebetween may adapt a wide variety of techniques known in the art. The drawings illustrate only one of them to describe the novel feature of withdrawing the jack frame 20 to the body 10. The slide mechanism consists of slide rails 12 attached to the body 10 and a slide means 26 located on the jack frame 20 matching the slide rails 12. Through coupling of the slide rails 12 and slide means 26, the jack frame 20 may be slid up or down relative to the body 10. In order to allow the jack frame 20 to form two stable states, i.e. a withdrawing state and an using state, on the body 10, the slide mechanism may have slide rail anchors 120, anchor bulges 220 and slots 22 formed thereon to attain the two stable states. Such anchoring features and techniques are also known in the art, thus will be omitted here.

Figure 4:
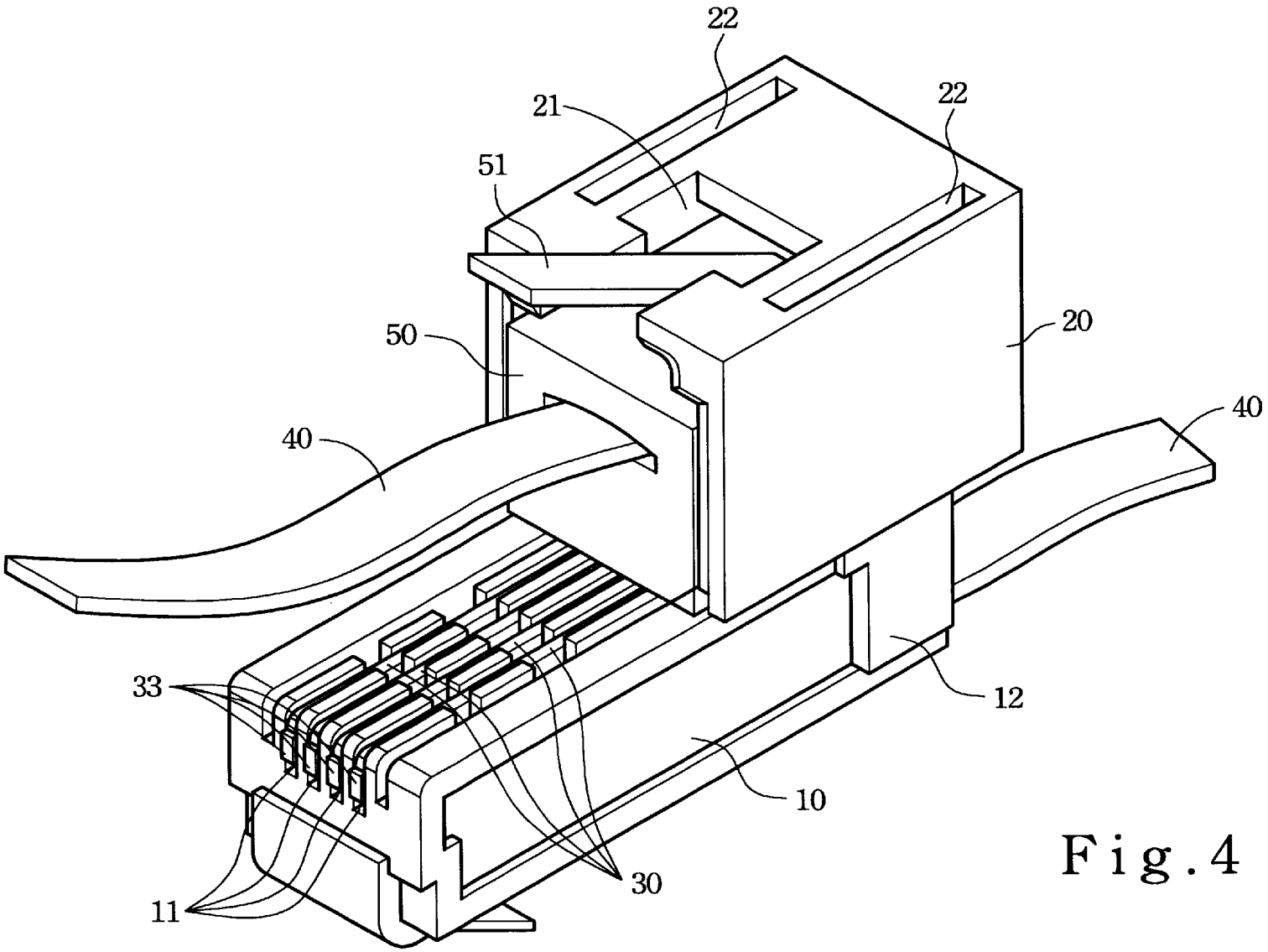
FIG. 4 is a perspective view of the second embodiment, with the jack frame moved up for use.

FIG. 4 shows the second embodiment in use, under an using state and engaged with an external plug 50.

Figure 5:
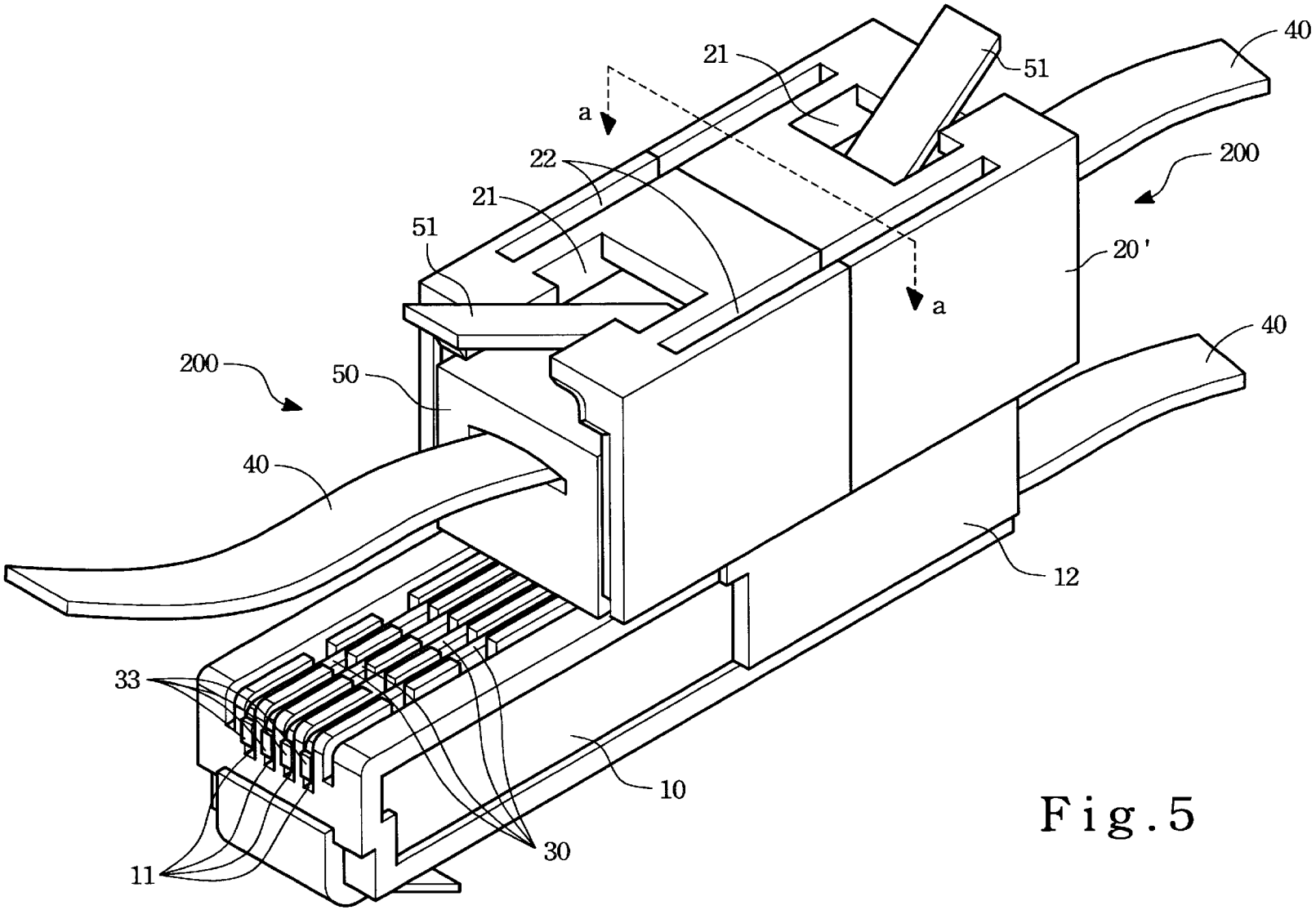
FIG. 5 is a perspective view of a third embodiment of the invention.

FIG. 5 depicts a third embodiment of the invention. The main difference from the first and second embodiment is that the third embodiment offers a dual jack structure to facilitate multiplexing applications.

The third embodiment, similar to the constructions set forth above, also includes a body 10, a jack frame 20' and a plurality of metal strips 30. The body 10 also has one end formed a plug structure matching an external jack, and another end connected a communication line 40, a plurality of longitudinal wire troughs 11 formed on one side of the body between the two ends, and a transverse slot (not shown in the drawing, located below the middle portion of the jack frame 20).

The jack frame 20' includes two sets of the jack frames 20 used in the first and second embodiment and which are coupled in a back to back manner, thereby to form respectively a jack space 200 at either end for receiving an external plug 50.

Figure 6:
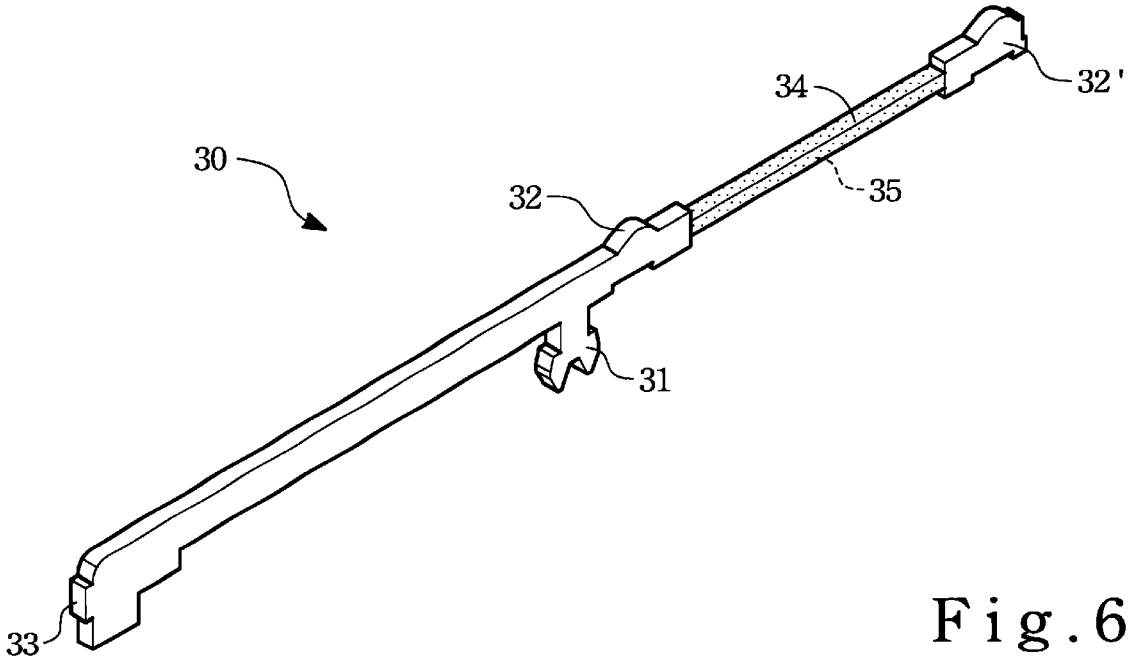
FIG. 6 is a perspective view of an embodiment of a metal strip for the third embodiment shown in FIG. 5.
Figure 7:
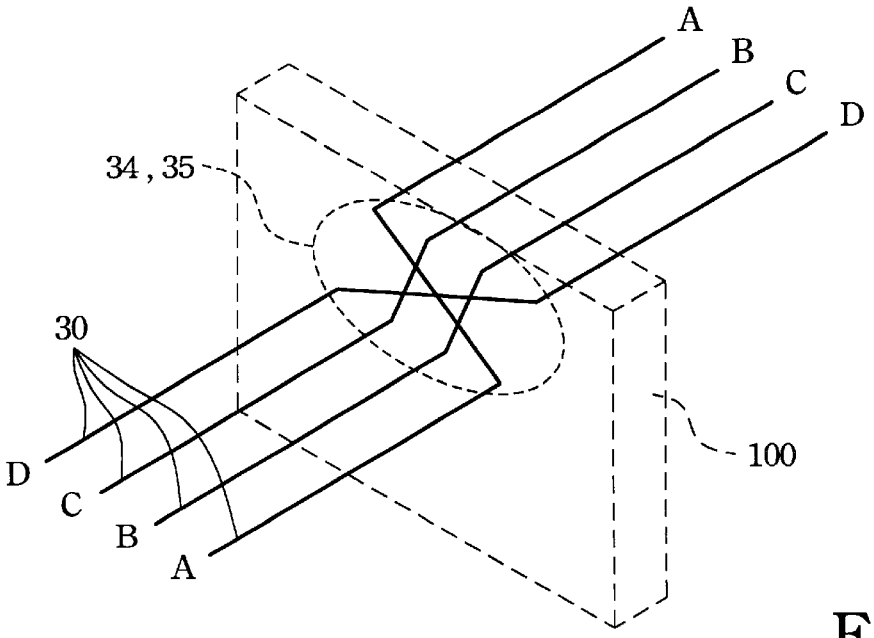
FIG. 7 is a schematic view of the metal strips configuration for the third embodiment shown in FIG. 5.

The metal strips 30 (referring to FIG. 6) are embedded in the wire troughs 11 of the body 10. Each metal strip 30 has a front bulged stub 33 formed at one end thereof, a lower bifurcate contact 31 connecting the communication line 40 in the wire trough, and a first upper jut 32 located at a middle portion and a second upper jut 32' located at another end. The metal strip between the first upper jut 32 and second upper jut 32' is a metal extension arm 35. When the metal strip 30 is embedded in the wire trough 11, the front bulged stub 33 is extended outside the plug structure, the first upper jut 32 and second upper jut 32' are extended outside the wire troughs 11. The metal extension arms 35 are located in the transverse slot 100 (shown in FIG. 7) to connect the metal strips 30 at two ends in a matching and staggering fashion, thereby the two jack space 200 may become two equal effect jack structures to the communication line 40 of the interface structure to connect two external communication lines which equips with plug structure.

In the preferred embodiments, in order to ensure that the metal strips 30 staggeringly located in the transverse slot 100 have proper insulation, the metal extension arms 35 may be covered by an insulation layer 34, The insulation layer 34 may be applied by the methods of coating, adhering, or the like.

In the third embodiment, the first upper jut 32 and second upper jut 32' of the metal strips 30 are exposed respectively to the two back to back jack space 200 in the jack frame 20 to allow two external plugs 50 to insert respectively into the jack space 200 through two front openings 24 formed at two corresponding ends of the jack frame 20 to contact the metal strips 30. The staggering arrangement of the metal strips 30 in the transverse slot 100 allows the two external plugs 50 having equal effect.

As depicted before, in the preferred embodiments, the interface structure of the invention may include a slide mechanism to allow the jack frame 20 moving downwards closed to the body 10 to shrink the jack space when not in use so that the size of the whole interface structure may be reduced. As mentioned in the first and second embodiment, the slide mechanism may include slide rails attached to the body 10 and a slide means located on the jack frame 20 to couple with the slide rails.

In the invention, the jack frame 20 may also be divided in a front and a rear frame (shown by broken line a-a in FIG. 5) each has a matching slide mechanism so that the two frames may be moved down separately toward the body 10 when not in use to shrink the corresponding jack space 200. Similarly, the slide mechanism may include slide rails attached to the body 10 and a slide means located on the jack frame 20 to couple with the slide rails.

In the invention, by means of a simple slide mechanism, the jack section may be lowered to the plug section when not in use to effectively reduce the occupied space of the interface structure.

In the present invention, through directly disposing the jack structure and plug structure on the communication line, the trouble of preparing an additional third connector for electronic devices may be avoided, and carrying of the devices becomes more convenient.

While the preferred embodiments of the invention have been set forth for purpose of disclosure, modifications of the disclosed embodiments of the invention as well as other embodiments thereof may occur to those skilled in the art (such as matching the screws and screw bores, or screw bolts and screw nuts, or other connection means). Accordingly, the appended claims are intended to cover all embodiments which do not depart from the spirit and scope of the invention.

What is claimed is:

1. A composite interface structure for jack-plug sockets for mounting to one end of a communication line, comprising:

a body having one end formed a plug structure matching an external jack and another end engaged with the communication line and a plurality of longitudinal wire troughs formed on one side of the body between the two ends;

a plurality of metal strips embedded in the corresponding wire troughs, each metal strip having a front bulged stub formed at one end thereof and extended outside the plug structure, a lower bifurcate contact connecting the communication line in the wire trough, and an upper jut located at an upper side of another end thereof and extended above the wire trough; and a jack frame straddled over one side of the body where the communication line located having a jack space formed therein to match an external plug and to allow the upper jut exposing therein, and a front opening adjacent the plug structure of the body to receive the external plug into the jack space to contact the metal strips.

2. The composite interface structure of claim 1 further having a slide mechanism to allow the jack frame moving downwards closed to the body for shrinking the jack space when not in use, the slide mechanism including slide rails attached to the body and a slide means located on the jack frame matching the slide rails.

3. A composite interface structure for jack-plug sockets for mounting to one end of a communication line, comprising:

a body having one end formed a plug structure matching an external jack and another end engaged with the communication line, a plurality of longitudinal wire troughs formed on one side of the body between the two ends, and a transverse slot communicating with the wire troughs;

a plurality of metal strips embedded in the corresponding wire troughs, each metal strip having a front bulged stub formed at one end thereof and extended outside the plug structure, a lower bifurcate contact connecting the communication line in the wire trough, a first upper jut, a second upper jut located at another end thereof, and a metal extension arm located between the first upper jut and the second upper jut, the first upper jut and the second upper jut being extended above the wire trough, the metal extension arms being located in the transverse slot and configuration with the metal strips in the transverse slot in a matching and staggering fashion; and a jack frame straddled over one side of the body where the communication line located having two openings located at two ends thereof on the side adjacent the wire troughs and two jack spaces formed respectively inside the jack frame from the openings to match respectively an external plug, the first upper jut and the second upper jut being exposed to the jack spaces, and the external plug being inserted into the jack space through the opening to contact the metal strips.

4. The composite interface structure of claim 3, wherein the metal extension arm being covered by an insulation layer.

5. The composite interface structure of claim 3 further having a slide mechanism to allow the jack frame moving downwards closed to the body for shrinking the jack space when not in use, the slide mechanism including slide rails attached to the body and a slide means located on the jack frame matching the slide rails.

6. The composite interface structure of claim 3, wherein the jack frame being divided in a front frame and a rear frame which have respectively a slide mechanism to allow the front frame and the rear frame to move respectively downwards closed to the body when not in use for shrinking the corresponding jack space, the slide mechanism including slide rails attached to the body and a slide means located on the jack frame matching the slide rails.

* * * * *